US011322121B2

(12) United States Patent
Futsuhara et al.

(10) Patent No.: US 11,322,121 B2
(45) Date of Patent: May 3, 2022

(54) MUSICAL INSTRUMENT AND KEYBOARD MUSICAL INSTRUMENT

(71) Applicant: YAMAHA CORPORATION, Hamamatsu (JP)

(72) Inventors: Yuki Futsuhara, Hamamatsu (JP); Minoru Iida, Hamamatsu (JP); Daisuke Haba, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/177,268

(22) Filed: Feb. 17, 2021

(65) Prior Publication Data

US 2021/0287639 A1 Sep. 16, 2021

(30) Foreign Application Priority Data

Mar. 13, 2020 (JP) ..... JP2020-044087

(51) Int. Cl.
*G10G 7/00* (2006.01)
*G10G 1/00* (2006.01)

(52) U.S. Cl.
CPC ..... *G10G 7/00* (2013.01); *G10G 1/00* (2013.01)

(58) Field of Classification Search
None
See application file for complete search history.

(56) References Cited

U.S. PATENT DOCUMENTS 9,489,054 B1 * 11/2016 Sumsion ..... G06F 1/1681

FOREIGN PATENT DOCUMENTS

JP 4656020 B2 3/2011

OTHER PUBLICATIONS

Yamaha Corporation. "Instruction Manual of Digital Piano P-125 P-121" dated Jan. 2019. English translation provided. Cited in Specification.

* cited by examiner

*Primary Examiner* — Kimberly R Lockett
(74) *Attorney, Agent, or Firm* — Rossi, Kimms & McDowell LLP

(57) ABSTRACT

A musical instrument to which a music stand is to be attached includes a performance operation unit that is arranged in a front portion of the musical instrument in a front-and-rear direction, and an attachment portion arranged at a position farther rearward than a rear end of the performance operation unit in the front-and-rear direction and farther forward than an intermediate position between the rear end of the performance operation unit and a rear end of the musical instrument in the front-and-rear direction, wherein the music stand is attached to the attachment portion such that a music score provision surface of the music stand is inclined by a first angle, and the first angle is in a range of 35 degrees to 55 degrees with respect to a horizontal plane.

12 Claims, 9 Drawing Sheets

MUSICAL INSTRUMENT AND KEYBOARD MUSICAL INSTRUMENT

BACKGROUND

Technical Field

The present disclosure relates to a musical instrument and a keyboard musical instrument to which a music stand is attachable.

Description of Related Art

A music stand is attached to a position farther rearward than a keyboard in a keyboard musical instrument, for example. A player gives a musical performance while viewing a music score placed on the music stand.

Recently, an electronic music score is often used instead of a paper music score. The electronic music score is stored in an electronic terminal such as a tablet. A player gives a musical performance while viewing an electronic music score and various musical performance information displayed on the screen of an electronic terminal placed on a music stand. Further, an application program is installed in an electronic terminal, whereby various settings with respect to an electronic musical instrument can be made using the electronic terminal. The player can perform various setting operations with respect to the electronic musical instrument by operating the electronic terminal placed on the music stand.

On the page 4 of "INSTRUCTION MANUAL OF DIGITAL PIANO P-125 P-121" which is issued in January 2019 by Yamaha Corporation, a music stand to be attached to an electronic keyboard musical instrument is shown as an accessory.

SUMMARY

A music stand is originally prepared for placement of a paper music score. It is an important element for a player who gives a musical performance that a music stand has a more convenient structure in a case where an electronic terminal such as a tablet displays an electronic music score.

An object of the present disclosure is to provide a musical instrument and a keyboard musical instrument that have a structure suited for utilization of an electronic terminal.

A musical instrument according to one aspect of the present disclosure to which a music stand is to be attached includes a performance operation unit that is arranged in a front portion of the musical instrument in a front-and-rear direction, and an attachment portion arranged at a position farther rearward than a rear end of the performance operation unit in the front-and-rear direction and farther forward than an intermediate position between the rear end of the performance operation unit and a rear end of the musical instrument in the front-and-rear direction, wherein the music stand is attached to the attachment portion such that a music score provision surface is inclined by a first angle, and the first angle is in a range of 35 degrees to 55 degrees with respect to a horizontal plane.

Other features, elements, characteristics, and advantages of the present disclosure will become more apparent from the following description of preferred embodiments of the present disclosure with reference to the attached drawings.

DETAILED DESCRIPTION

(1) Configuration of Musical Instrument

Figure 1:
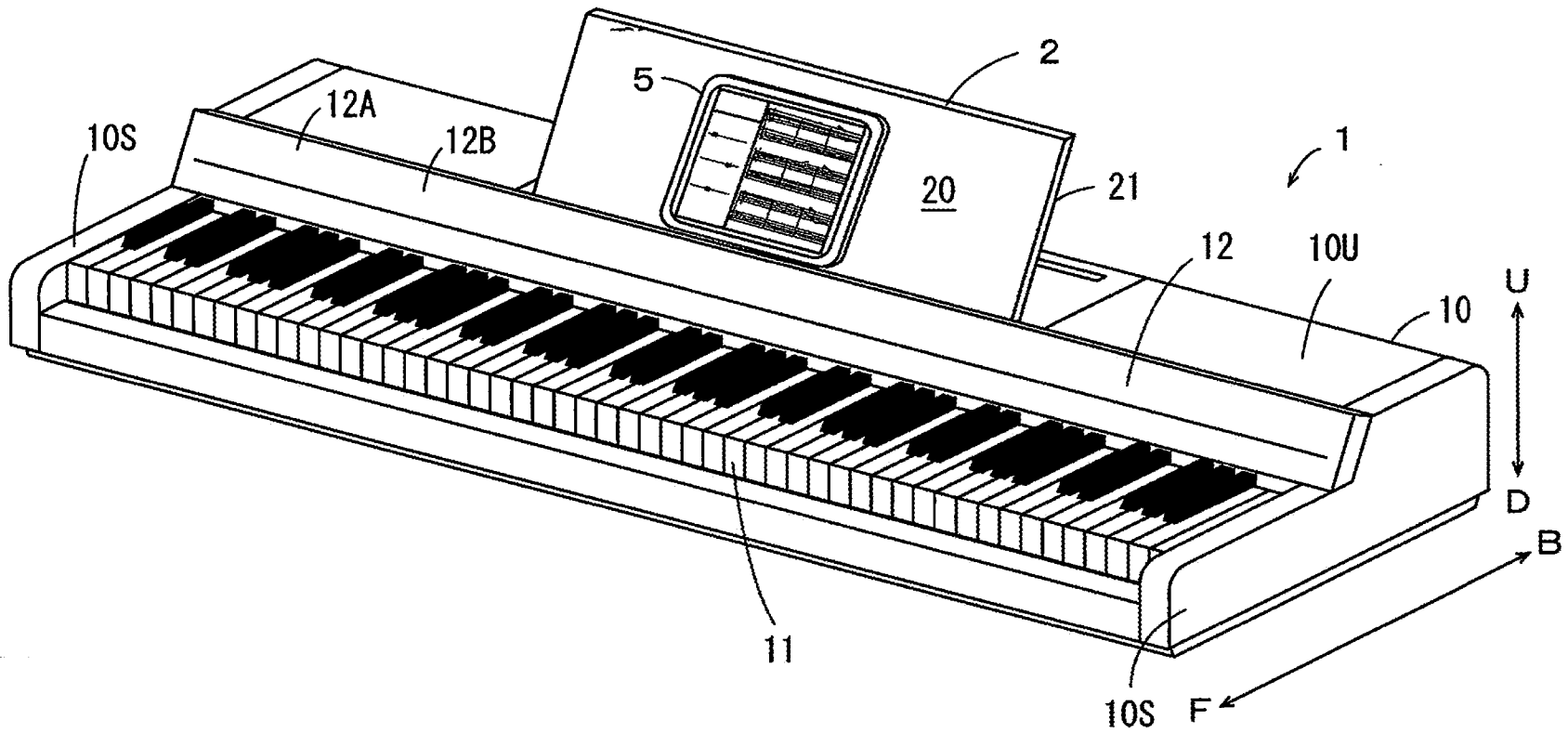
FIG. 1 is a perspective view of an electronic keyboard musical instrument according to an embodiment.
Figure 2:
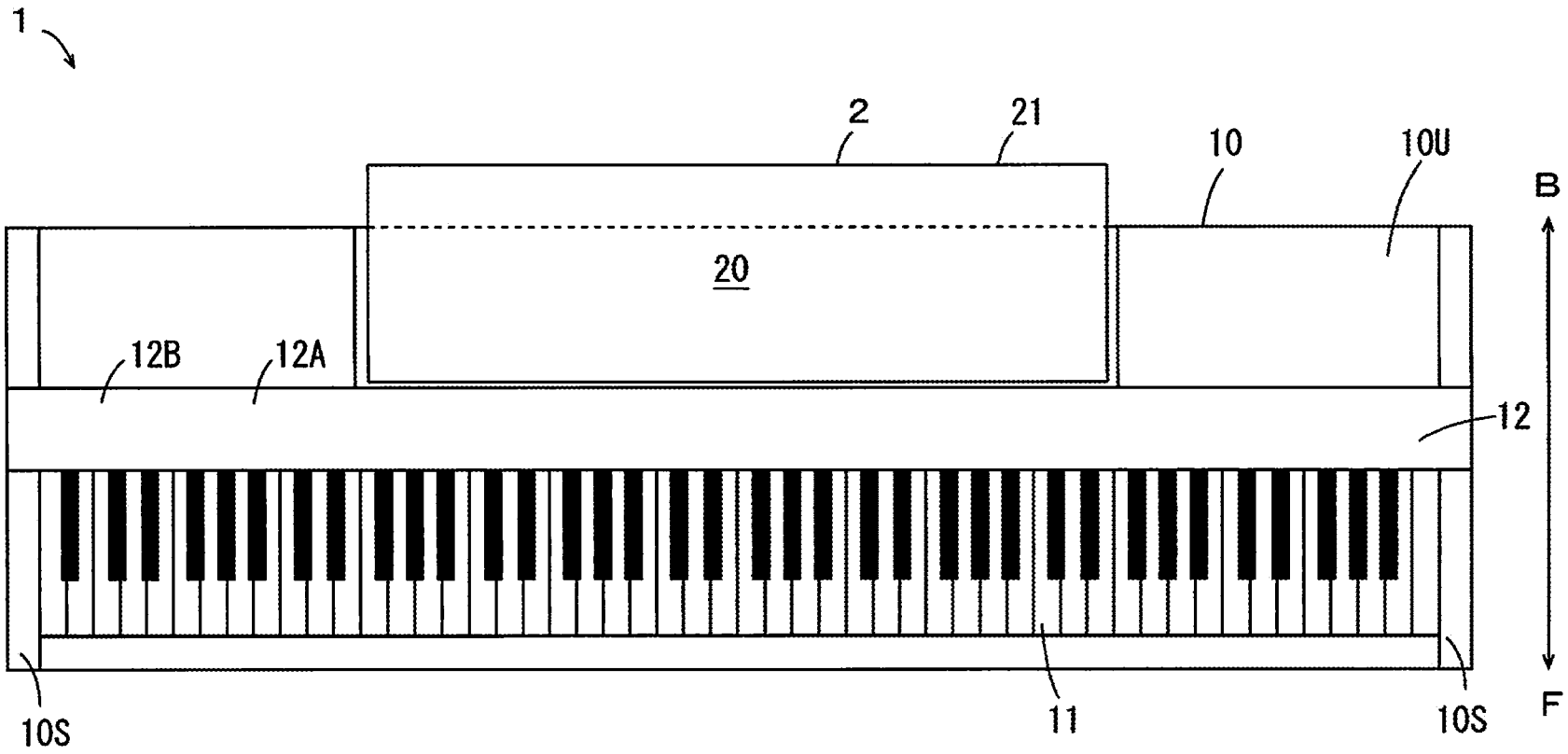
FIG. 2 is a plan view of the electronic keyboard musical instrument according to the embodiment.
Figure 3:
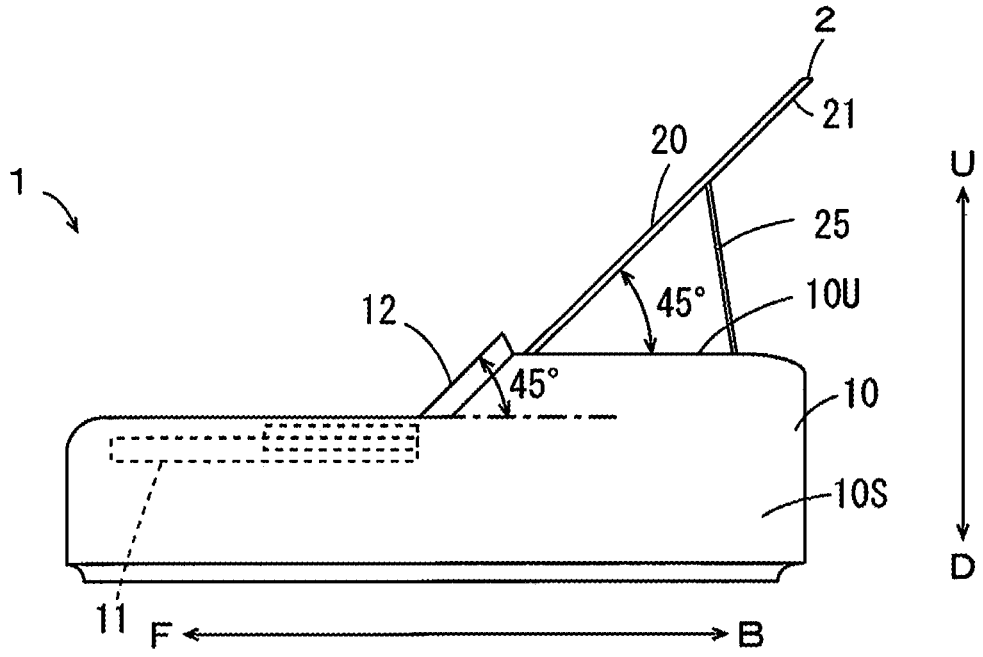
FIG. 3 is a side view of the electronic keyboard musical instrument according to the embodiment.

A musical instrument according to an embodiment of the present disclosure will be described below in detail with reference to the drawings. FIG. 1 is a perspective view of an electronic keyboard musical instrument 1 which is the musical instrument according to the embodiment. FIG. 2 is a plan view of the electronic keyboard musical instrument 1. FIG. 3 is a side view of the electronic keyboard musical instrument 1. In each of the diagrams, forward, rearward, upward and downward of the electronic keyboard musical instrument 1 are indicated by reference characters F, B, U and D, respectively.

As shown in FIG. 1 and FIG. 2, the electronic keyboard musical instrument 1 includes a casing 10. The casing 10 includes left and right side plates 10S and an upper plate 10U. A keyboard 11 is arranged in a front portion of the casing 10. A panel 12 is arranged at a position farther rearward than the keyboard 11. The panel 12 includes a function as a display 12A that displays information and a function as an operation unit 12B that receives an operation. As shown in FIG. 1 and FIG. 2, the panel 12 extends along the entire electronic keyboard musical instrument 1 in a left-and-right direction in the present embodiment. The display 12A and the operation unit 12B are arranged in part of the panel 12 or in the entire panel 12.

A tone color setting, a musical performance style, etc. are displayed in the display 12A. Operators for making a tone color setting, a musical performance style setting, a volume setting, a tempo setting, etc. are arranged in the operation unit 12B. A mechanical operation button, a dial and a touch-panel type operator are included in the operation unit 12B.

A music stand 2 is attached to the upper plate 10U of the electronic keyboard musical instrument 1. In the present embodiment, the music stand 2 is attached to a position farther rearward than the panel 12 to be adjacent to the panel 12. A tablet 5 is placed on the music stand 2. A musical performance assistance application program (hereinafter referred to as an assistance program) is installed in the tablet 5. The tablet 5 can display various musical performance assistance information in addition to an electronic music score on a touch panel display of the tablet 5 by executing the assistance program.

Further, the tablet 5 can display a user interface for various setting operations of the electronic keyboard musical instrument 1 on the touch panel of the tablet 5 by executing the assistance program. The tablet 5 can communicate with a controller of the electronic keyboard musical instrument 1 through wired communication such as a USB (Universal Serial Bus) or wireless communication such as BLUETOOTH (registered trademark) or a wireless LAN (Local Area Network). A player can make various settings with respect to the electronic keyboard musical instrument 1 by performing an input operation with respect to the user interface displayed on the touch panel display of the tablet 5.

As shown in FIG. 3, the music stand 2 is attached to extend rearwardly and obliquely upwardly from a position farther rearward than the panel 12. In the present embodiment, an inclination angle of the music stand 2 is substantially 45 degrees with respect to the upper plate 10U of the casing 10. Because the casing 10 is normally provided on a horizontal plane such as a piano stand or a desk, the upper plate 10U is substantially in parallel with the horizontal plane. Therefore, in the present embodiment, the inclination angle of the music stand 2 is substantially 45 degrees with respect to the horizontal plane. That is, the inclination angle of a music score provision surface 20 of the music stand 2 is substantially 45 degrees with respect to the upper plate 10U and the horizontal plane.

Further, as shown in FIG. 3, the inclination angle of the panel 12 is substantially 45 degrees with respect to the upper plate 10U of the casing 10. Therefore, the music score provision surface 20 of the music stand 2 is arranged to be substantially in parallel with a panel surface of the panel 12. As described above, the panel 12 includes the function as the display 12A that displays information and the function as the operation unit 12B that receives an operation. Because the player can view the information displayed in the display 12A and the touch panel display of the tablet 5 placed on the music stand 2 with a similar inclination angle, visibility of information is good. Further, because the operation unit 12B and the touch panel display of the tablet 5 are arranged to have a similar inclination angle, operability is good.

As shown in FIG. 3, a support bar 25 is provided at the back surface of the music stand 2. The support bar 25 extends rearwardly and obliquely downwardly from the back surface of the music stand 2 and is supported on the upper plate 10U. The music stand 2 is reinforced against the pressure in a front-and-rear direction and an up-and-down direction by including the support bar 25. The player is to apply a force in the front-and-rear direction and the up-and-down direction to the music stand 2 when operating the tablet 5 placed on the music stand 2. Since the music stand 2 is reinforced by the support bar 25, the music stand 2 does not sway or bend even when the player operates the tablet 5, and operability is good.

In the present embodiment, the music stand 2 is reinforced by provision of the support bar 25 at the back surface of the music stand 2. In addition, the music stand 2 may be reinforced by provision of a rib at the back surface of the music stand 2, for example.

(2) Configuration of Attachment Portion

Figure 4:
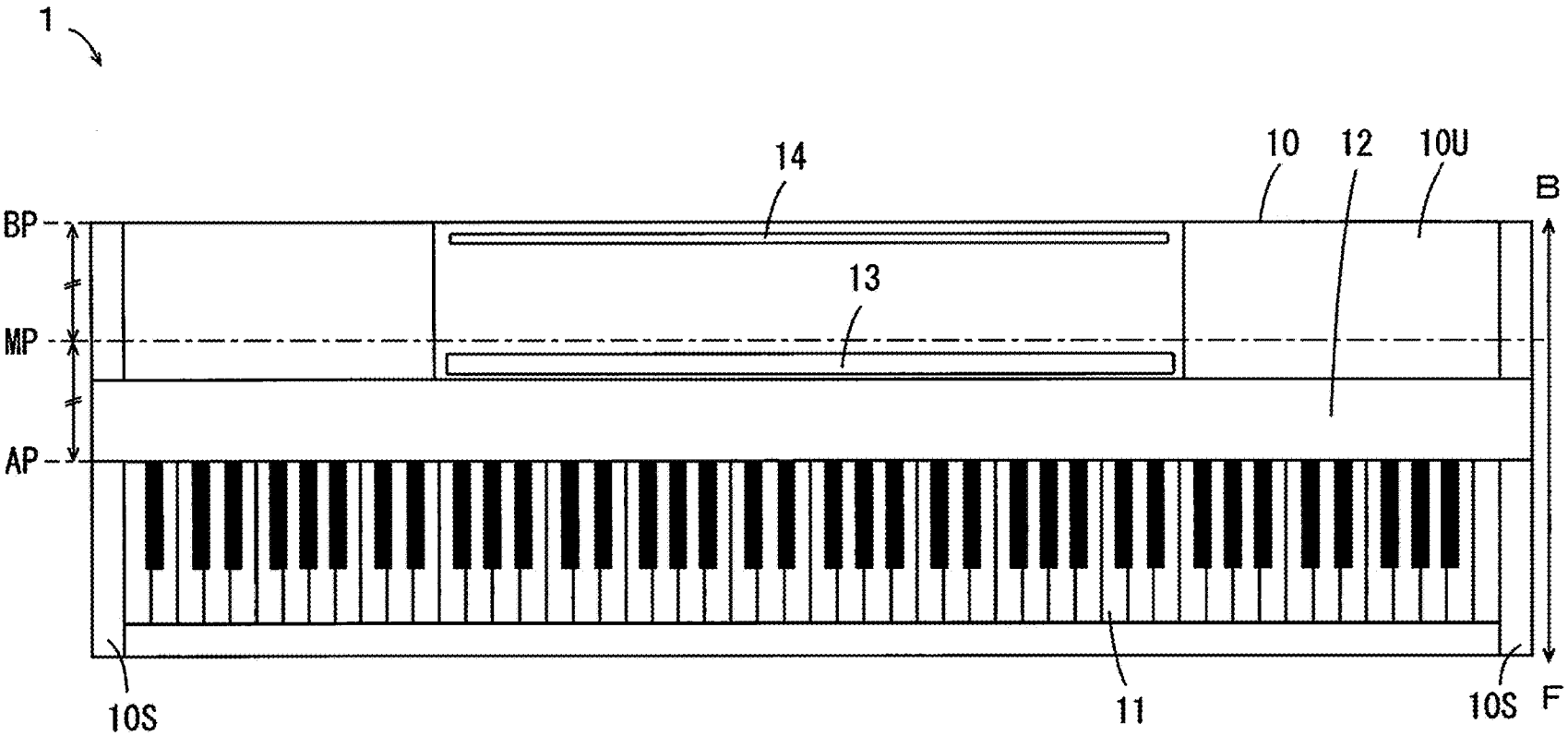
FIG. 4 is a plan view of the electronic keyboard musical instrument from which a music stand is detached.

FIG. 4 is a plan view of the electronic keyboard musical instrument 1 with the music stand 2 detached. As shown in the diagram, an attachment portion 13 and a guide 14 are provided in the upper plate 10U of the casing 10. The attachment portion 13 includes a groove extending in the left-and-right direction in the upper surface of the upper plate 10U. The lower end of the music stand 2 is attached to the attachment portion 13. The guide 14 includes a groove, extending substantially in parallel with the attachment portion 13 and in the left-and-right direction, in the upper surface of the upper plate 10U. In the guide 14, the support bar 25 of the music stand 2 is supported.

In FIG. 4, a position AP indicates the position of the rear end of the keyboard 11 in the front-and-rear direction of the electronic keyboard musical instrument 1. A position BP indicates the position of the rear end of the electronic keyboard musical instrument 1 in the front-and-rear direction of the electronic keyboard musical instrument 1. A position MP indicates the intermediate position between the position AP and the position BP in the front-and-rear direction of the electronic keyboard musical instrument 1. In this manner, in the electronic keyboard musical instrument 1 of the present embodiment, the attachment portion 13 is arranged at a position farther forward than the position MP which is the intermediate position between the position AP that is the position of the rear end of the keyboard 11 and the position BP that is the position of the rear end of the electronic keyboard musical instrument 1 in the front-and-rear direction of the electronic keyboard musical instrument 1. Thus, the music stand 2 is arranged at a position close to the keyboard 11. When the tablet 5 is placed on the music stand 2, the tablet 5 is arranged at a position relatively close to the player. Thus, the player can easily operate the tablet 5.

In the present embodiment in particular, the attachment portion 13 is arranged to be adjacent to the rear end of the panel 12. The attachment portion 13 is arranged at the closest position from the keyboard 11 in the area farther rearward than the panel 12. Thus, the player can easily operate the tablet 5.

(3) Configuration of Music Stand

Figure 5:
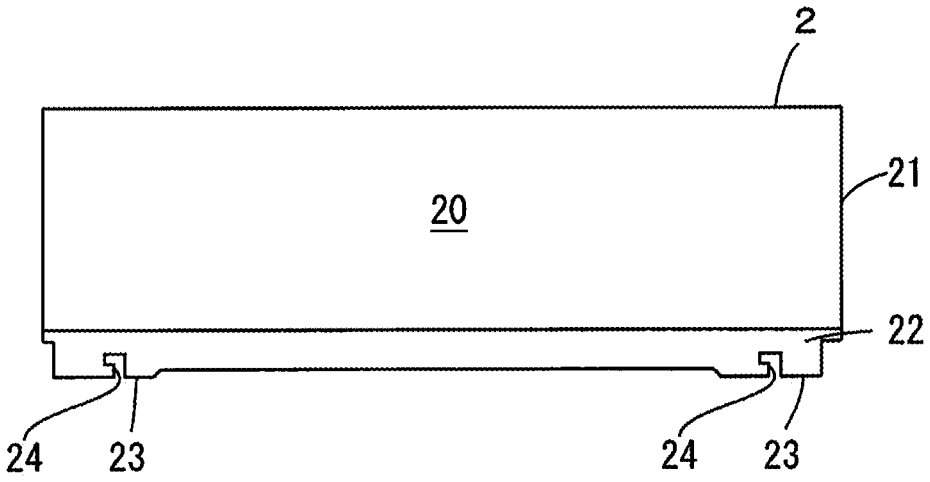
FIG. 5 is a plan view of the music stand to be attached to the electronic keyboard musical instrument.
Figure 6:
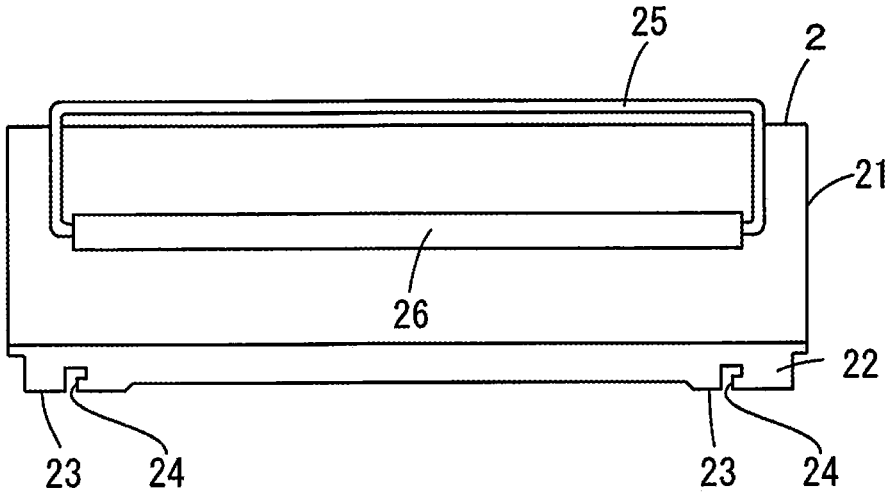
FIG. 6 is a back view of the music stand to be attached to the electronic keyboard musical instrument.

FIG. 5 is a plan view of the music stand 2. FIG. 6 is a back view of the music stand 2. The music stand 2 includes a main body 21 and a connection portion 22. The front side of the main body 21 is the music score provision surface 20. The connection portion 22 is connected to a lower portion of the main body 21. In the present embodiment, the main body 21 and the connection portion 22 are integrally formed. While the music stand 2 is constituted by resin in the present embodiment, the music stand 2 may also be constituted by wood, metal, etc.

In the present embodiment, emboss processing is performed on the music score provision surface 20 of the music stand 2. The emboss processing may be performed on the entire music score provision surface 20 or may be performed on part of the music score provision surface 20. Since the emboss processing is performed on the music score provision surface 20, an anti-slip effect is provided to the music score provision surface 20. Thus, even in a case where the tablet 5 is placed on the music stand 2, and an operation is performed on the tablet 5, the position of the tablet 5 is prevented from being shifted, and operability is improved.

Figure 7:
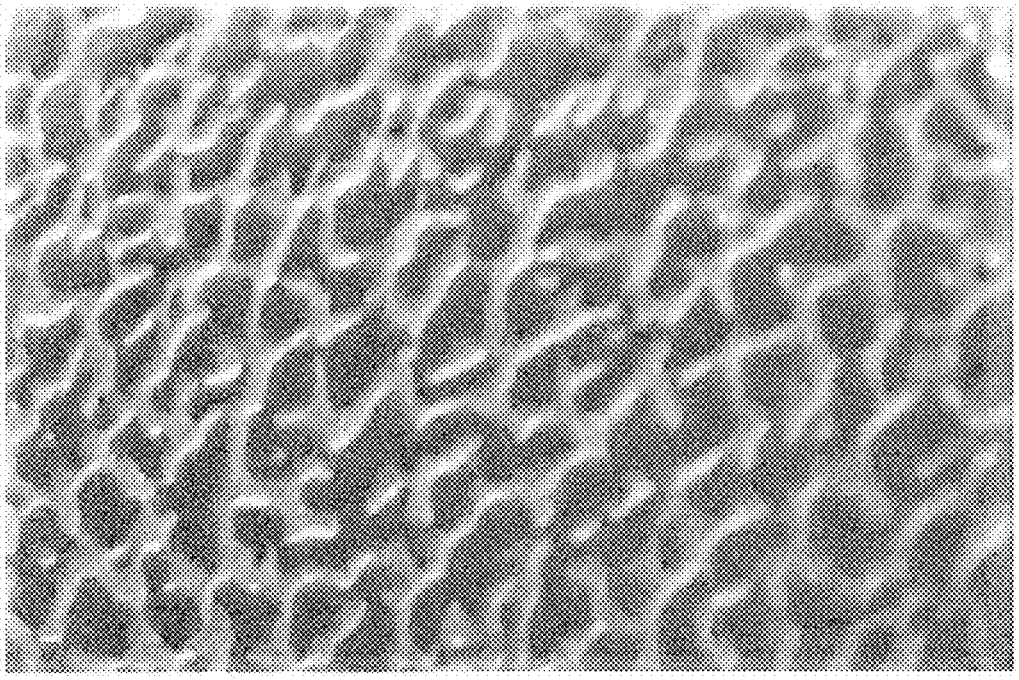
FIG. 7 is a diagram showing one example of a music score provision surface on which emboss processing is performed.
Figure 8:
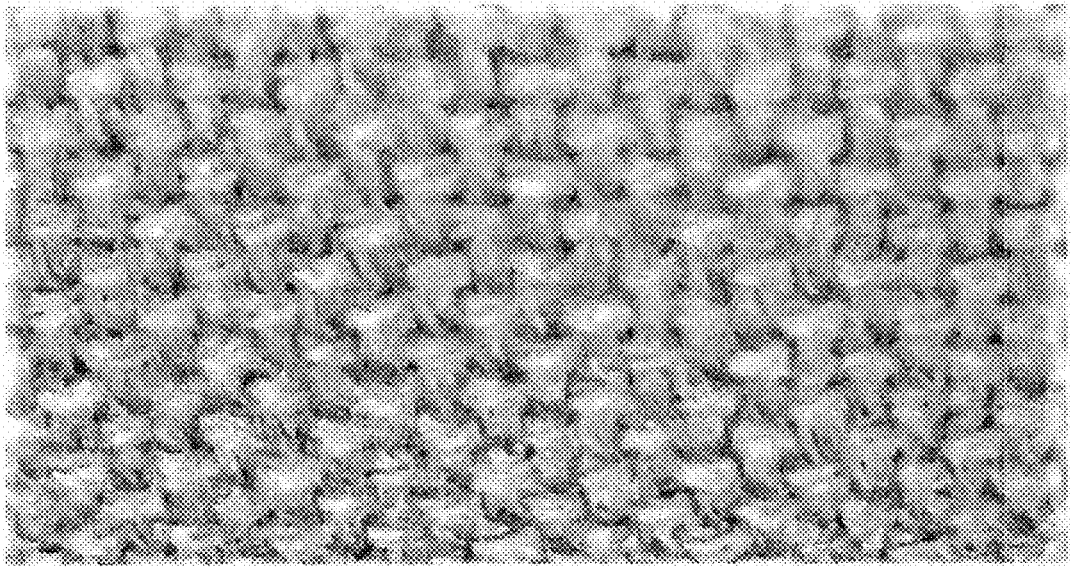
FIG. 8 is a diagram showing another example of a music score provision surface on which emboss processing is performed.

FIG. 7 is a diagram showing one example of the music score provision surface 20 on which the emboss processing is performed. In the example of FIG. 7, lines are provided on the music score provision surface 20. FIG. 8 is a diagram showing another example of a music score provision surface 20 on which emboss processing is performed. In the example of FIG. 8, a plurality of concaves are provided on the music score provision surface 20.

As shown in FIGS. 5 and 6, left and right projections 23, 23 are formed in the connection portion 22. Engagement grooves 24, 24 are formed in the projections 23, 23, respectively. The projections 23, 23 and the engagement grooves 24, 24 are used when the music stand 2 is attached to the electronic keyboard musical instrument 1.

As shown in FIG. 6, the support bar 25 is attached to the back surface of the main body 21. The support bar 25 is attached to an attachment member 26 that extends in the left-and-right direction on the back surface of the main body 21. The support bar 25 is attached to be rotatable with respect to the attachment member 26 with the attachment member 26 used as a rotation axis (the axis extending in the left-and-right direction).

Figure 9:
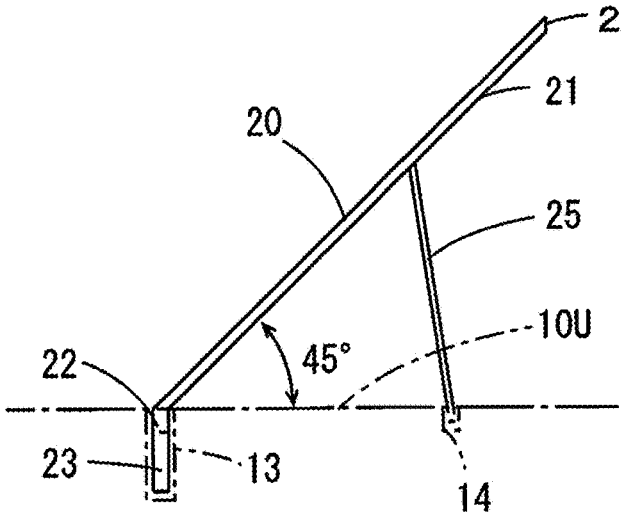
FIG. 9 is a side view of the music stand to be attached to the electronic keyboard musical instrument.

FIG. 9 is a side view of the music stand 2 being attached to the electronic keyboard musical instrument 1. As shown in FIG. 9, the main body 21 of the music stand 2 is arranged to have the inclination angle of substantially 45 degrees with respect to the upper plate 10U of the electronic keyboard musical instrument 1. Further, the main body 21 and the connection portion 22 of the music stand 2 are connected to each other to have the inclination angle of substantially 135 degrees in a side view. Therefore, the connection portion 22 is attached to be vertical to the upper plate 10U, whereby the main body 21 is arranged to have the inclination angle of substantially 45 degrees with respect to the upper plate 10U.

As shown in FIG. 9, the connection portion 22 of the music stand 2 is fitted to the groove formed in the attachment portion 13. Further, the support bar 25 is fitted to the guide 14. The guide 14 is a shallow groove and can restrict movement of the support bar 25 in the front-and-rear direction.

In this manner, in the present embodiment, the music score provision surface 20 of the music stand 2 is arranged to have the inclination angle of substantially 45 degrees with respect to the horizontal plane. Because the music score provision surface 20 is arranged to have a relatively small inclination angle, when the tablet 5 is placed on the music stand 2, the player can easily operate the tablet 5. In a conventional piano, an electronic piano and the like, a music stand has a relatively large inclination angle such as 75 degrees with respect to the horizontal plane. Although there is no problem in viewing a paper music score with such a music stand, it is not suitable for operating a tablet. In the present embodiment, the inclination angle of the music score provision surface 20 of the music stand 2 is set to an angle suitable for operating the tablet 5.

While the inclination angle of the music score provision surface 20 of the music stand 2 is substantially 45 degrees with respect to the horizontal plane in the present embodiment, this is merely one example. The inclination angle may be designed in a range suitable for an operation of the tablet 5. In regard to the angular range suitable for an operation of the tablet 5, the inclination angle of the music score provision surface 20 of the music stand 2 is desirably in a range of 35 degrees to 55 degrees with respect to the horizontal plane. That is, the inclination angle between the main body 21 and the connection portion 22 is desirably set in a range of 125 degrees to 145 degrees. In a case where the inclination angle of the music score provision surface 20 with respect to the horizontal plane exceeds 55 degrees, the angle of a hand that operates the touch panel display of the tablet 5 becomes awkward, and operability is lowered. Further, in a case where the inclination angle of the music score provision surface 20 with respect to the horizontal plane is smaller than 35 degrees, visibility of the information displayed on the touch panel display of the tablet 5 is lowered. Further, the inclination angle of the music score provision surface 20 of the music stand 2 with respect to the horizontal plane is desirably in a range of 40 degrees to 50 degrees. That is, the inclination angle between the main body 21 and the connection portion 22 is more desirably set in a range of 130 degrees to 140 degrees.

In this manner, in the present embodiment, the music score provision surface 20 of the music stand 2 is arranged to have the inclination angle of substantially 45 degrees with respect to the horizontal plane. Further, the panel 12 is arranged to have the inclination angle of substantially 45 degrees with respect to the horizontal plane. Therefore, as shown in FIG. 3, the panel 12 and the music score provision surface 20 are arranged substantially in parallel with each other. Thus, the player can view the display 12A arranged in the panel 12 and the touch panel display of the tablet 5 placed on the music stand 2 with a similar inclination angle. Thus, the player can easily view the information presented by the panel 12 and the tablet 5. Further, the player can operate the operation unit 12B arranged in the panel 12 and the touch panel display of the tablet 5 placed on the music stand 2 with a similar inclination angle. Thus, the player can easily perform a setting operation with respect to the panel 12 and the tablet 5.

(4) Attachment Structure

Figure 10:
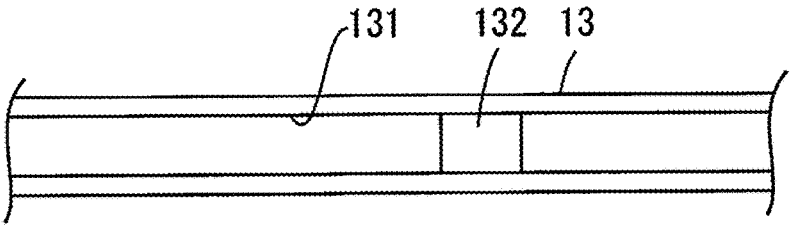
FIG. 10 is an enlarged view of an attachment portion.
Figure 11:
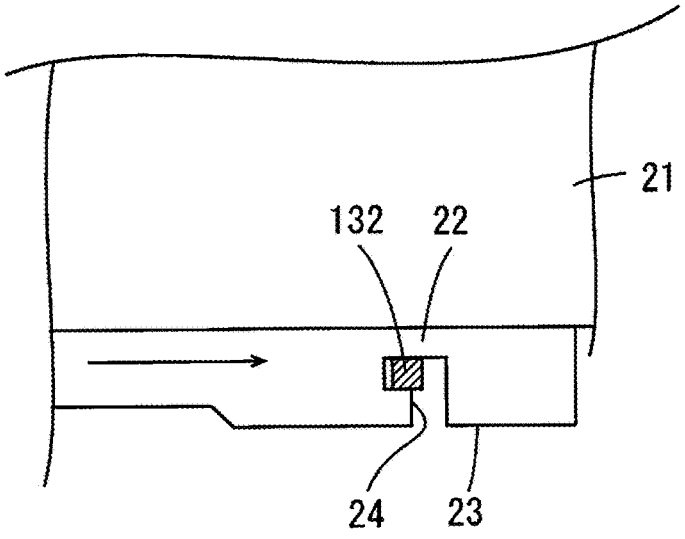
FIG. 11 is a diagram showing the music stand being attached to the attachment portion.

FIG. 10 is an enlarged view of the attachment portion 13 provided in the upper plate 10U. The attachment portion 13 has an insertion groove 131 that extends in the left-and-right direction of the upper plate 10U. The connection portion 22 of the music stand 2 is inserted into the insertion groove 131. Further, the attachment portion 13 has an engaging claw 132 in the insertion groove 131. As shown in FIG. 11, the connection portion 22 of the music stand 2 is inserted into the insertion groove 131, and then the music stand 2 is moved in the direction of the arrow shown in FIG. 11. Thus, the engaging claw 132 engages with the engagement groove 24. Thus, the music stand 2 is fixed to the attachment portion 13 of the upper plate 10U.

(5) Effects of Embodiment

As described above, in the electronic keyboard musical instrument 1 according to the present embodiment, the attachment portion 13 for attaching the music stand 2 is arranged at a position farther rearward than the rear end position AP of the keyboard 11 in the front-and-rear direction and farther forward than the intermediate position MP between the rear end position AP of the keyboard 11 and the rear end position BP of the electronic keyboard musical instrument 1 in the front-and-rear direction. Further, the music score provision surface 20 of the music stand 2 is set in the attachment portion 13 to be inclined with respect to horizontal plane in the range of 35 degrees to 55 degrees. Thus, the player can easily operate an electronic terminal placed on the music stand 2.

Further, when the connection portion 22 provided at the lower end of the music stand 2 is attached to the attachment portion 13, the main body 21 having the music score provision surface 20 may be connected to an upper portion of the connection portion 22 to have an inclination angle such that the inclination angle of the music score provision surface 20 with respect to the horizontal plane is from 35 degrees to 55 degrees. It is possible to set the inclination angle of the music score provision surface 20 to an angle suitable for an operation of an electronic terminal by attaching the connection portion 22 to the attachment portion 13.

Further, the inclination angle of the music score provision surface 20 with respect to the horizontal plane may be in the range of 40 degrees to 50 degrees. Further, the player can easily operate the electronic terminal placed on the music stand 2.

Further, the display 12A that displays information and/or the operation unit 12B that receives an operation may be arranged between the keyboard 11 and the attachment portion 13 in the front-and-rear direction. The visibility of the display 12A and/or the operability with respect to the operation unit 12B can be ensured.

The attachment portion 13 may be arranged to be adjacent to the rear end of the display 12A and/or the operation unit 12B in the front-and-rear direction. Since the attachment portion 13 is arranged at a position close to the keyboard 11, the player can easily operate the electronic terminal placed on the music stand 2.

The music score provision surface 20 may be arranged to be substantially in parallel with the display 12A and/or the operation unit 12B. Because the display 12A and/or the operation unit 12B, and the screen of the electronic terminal placed on the music stand 2 are arranged to have a similar inclination angle, visibility of information and/or operability of a setting operation, etc. is improved.

Anti-shift processing may be performed on the music score provision surface 20. A shift of the electronic terminal placed on the music stand 2 is suppressed, and operability of the electronic terminal is improved.

A reinforcer may be provided on the back surface of the main body 21 having the music score provision surface 20. Even in a case where the electronic terminal placed on the music stand 2 is operated, swaying or bending of the music stand 2 is suppressed, and operability of the electronic terminal is improved.

(6) Modified Example

Figure 12:
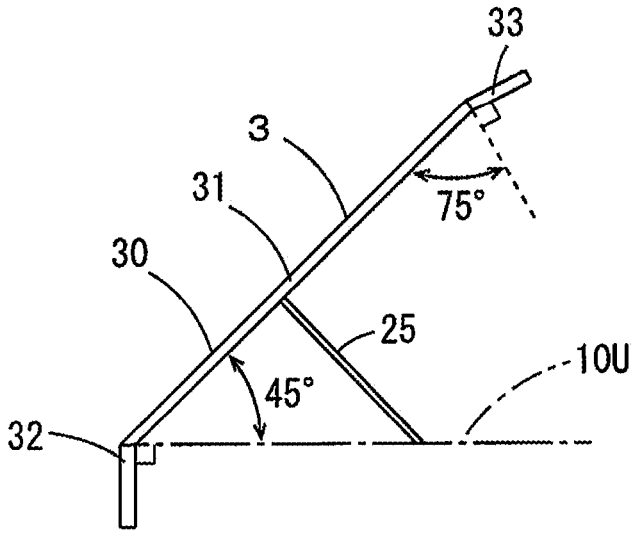
FIG. 12 is a side view of a music stand of a modified example.
Figure 13A:
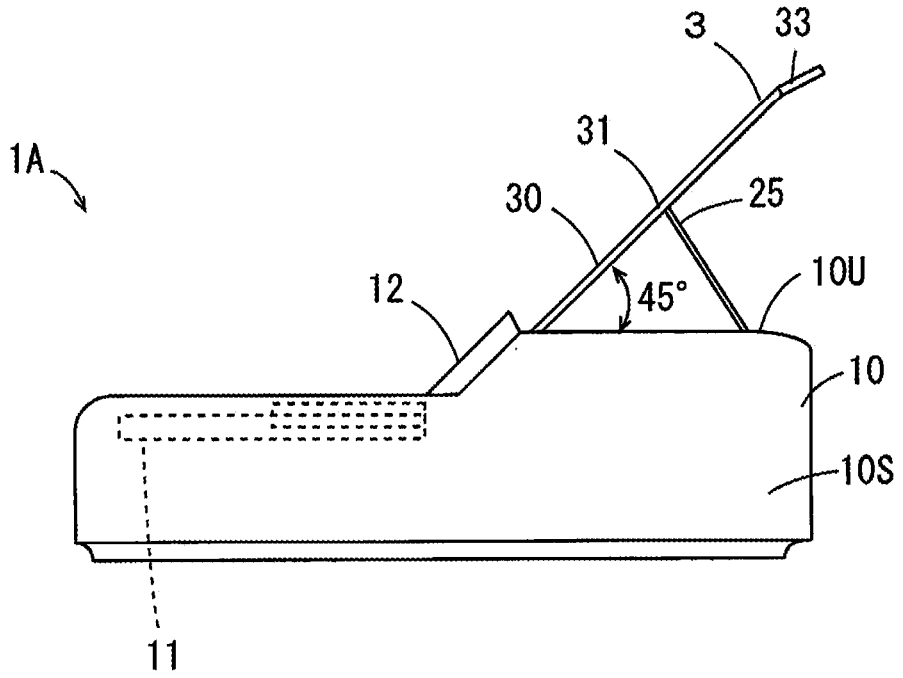
FIGS. 13A and 13B are side views of an electronic keyboard musical instrument according to the modified example and to which a music stand is attached.
Figure 13B:
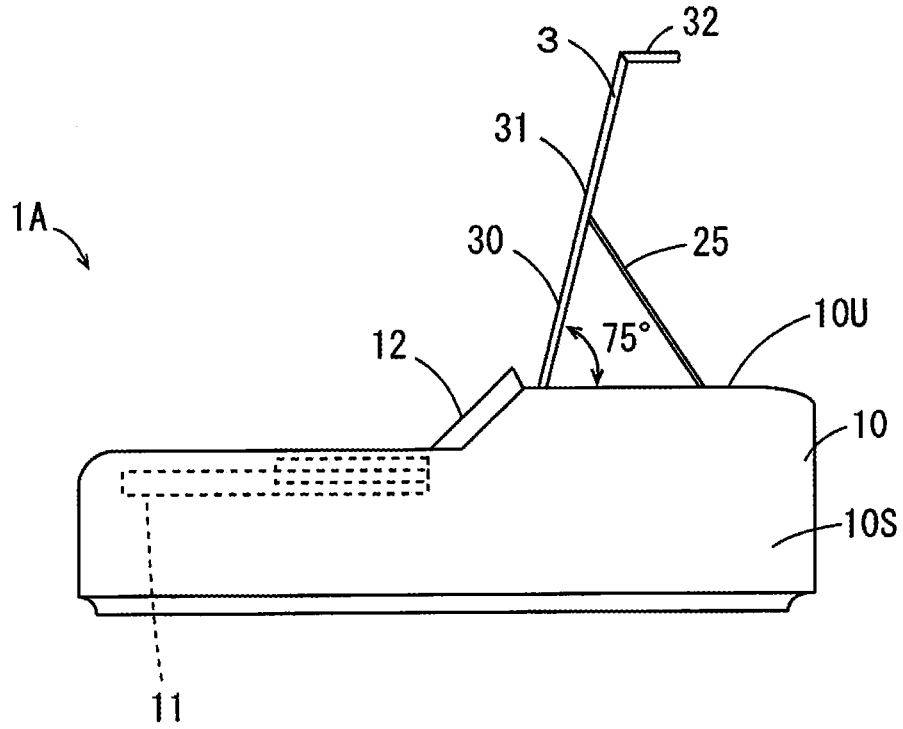

Next, an electronic keyboard musical instrument 1A according to a modified example of the present disclosure will be described with reference to FIGS. 12, 13A and 13B. FIG. 12 is a side view of a music stand 3 to be attached to the electronic keyboard musical instrument 1A according to the modified example. FIGS. 13A and 13B are side views of the electronic keyboard musical instrument 1A to which the music stand 3 is attached.

As shown in FIG. 12, the music stand 3 has a connection portion 32 in a lower portion of a main body 31 and has a connection portion 33 in an upper portion of the main body 31. In the present embodiment, the connection portion 32 is connected to the main body 31 to have an inclination angle of 135 degrees (90 degrees+45 degrees). Further, in the present embodiment, the connection portion 33 is connected to the main body 31 to have an inclination angle of 165 degrees (90 degrees+75 degrees).

FIG. 13A is a side view of the electronic keyboard musical instrument 1A in which the connection portion 32 is fixed to an attachment portion 13. Because the connection portion 32 is connected to the main body 31 to have an inclination angle of 135 degrees (90 degrees+45 degrees), in a case where the connection portion 32 is attached to be vertical to the upper plate 10U, a music score provision surface 30 of the music stand 3 has an inclination angle of substantially 45 degrees with respect to a horizontal plane. That is, the inclination angle of the music score provision surface 30 is similar to that of the electronic keyboard musical instrument 1 shown in FIG. 3. Therefore, the state of FIG. 13A is suitable for a musical performance style in which the tablet 5 is placed on the music stand 3.

FIG. 13B is a side view of the electronic keyboard musical instrument 1A in which the music stand 3 is placed upside down and the connection portion 33 is fixed to the attachment portion 13. Because the connection portion 33 is connected to the main body 31 to have an inclination angle of 165 degrees (90 degrees+75 degrees), in a case where the connection portion 33 is attached to be vertical to the upper plate 10U, the music score provision surface 30 of the music stand 3 has an inclination angle of substantially 75 degrees with respect to the horizontal plane. In this manner, in the state of FIG. 13B, the music score provision surface 30 has the inclination angle similar to that of a music stand of a conventional keyboard musical instrument. Therefore, the state of FIG. 13B is suitable for a conventional musical performance style in which a paper music score is viewed.

While the inclination angle of the music score provision surface 30 is 45 degrees with the connection portion 32 fixed to the attachment portion 13 in the examples shown in FIGS. 12, 13A and 13B, this is merely one example. For example, the inclination angle between the connection portion 32 and the main body 31 is settable in a range of 125 degrees to 145 degrees such that the inclination angle of the music score provision surface 30 is from 35 degrees to 55 degrees. Further, although the inclination angle of the music score provision surface is 75 degrees with the connection portion 33 fixed to the attachment portion 13, this is merely one example. For example, the inclination angle between the connection portion 33 and the main body 31 is settable in a range of being equal to or larger than 145 degrees such that the inclination angle of the music score provision surface 30 is equal to or larger than 55 degrees.

(7) Effects of Modified Example

As described above, the connection portion 33 is connected to a position different from the position of the connection portion 32 in the main body 31 of the music stand 3. When the connection portion 33 is attached to the attachment portion 13, the connection portion 33 and the main body 31 are connected to each other to have an inclination angle such that the inclination angle of the music score provision surface 30 with respect to the horizontal plane is equal to or larger than 55 degrees. Thus, the connection portion 33 is fixed to the attachment portion 13, whereby the music stand 3 has the structure suited for a musical performance style in which a conventional paper music score is placed on the music stand 3. Further, the connection portion 32 is fixed to the attachment portion 13, whereby the music stand 3 has the structure suited for a musical performance style in which the tablet 5 is placed on the music stand 3.

(8) Other Embodiments

In the above-mentioned embodiment, the attachment portion 13 is arranged to be adjacent to the rear end of the panel 12. That is, the attachment portion 13 is arranged to be adjacent to the rear ends of the display 12A and the operation unit 12B. In another embodiment, the attachment portion 13 may be arranged to be adjacent to the rear end of the keyboard 11.

While the tablet 5 is described as an electronic terminal to be placed on the music stand 2, 3 by way of example in the above-mentioned embodiment, this is merely one example. For example, a smartphone or a thin laptop computer may be placed on the music stand 2, 3 as an electronic terminal.

In the above-mentioned embodiment, the electronic keyboard musical instruments 1, 1A are described as the embodiments of the musical instrument of the present disclosure, by way of example. Additionally, the present disclosure can be applied to a keyboard musical instrument other than an electronic keyboard musical instrument. The keyboard musical instrument includes an acoustic piano, an organ and the like.

(9) Correspondences Between Constituent Elements in Claims and Parts in Preferred Embodiments In the following paragraphs, non-limiting examples of correspondences between various elements recited in the claims below and those described above with respect to various preferred embodiments of the present disclosure are explained.

In the above-mentioned embodiment, the keyboard 11 is an example of a performance operation unit. In the above-mentioned embodiment, the support bar 25 is an example of a reinforcer. In the above-mentioned embodiment, the connection portion 33 is an example of an additional connection portion. In the above-mentioned embodiment, the inclination angle of the music score provision surface 20 or the music score provision surface 30 with respect to the horizontal plane in a case where the connection portion 22 or the connection portion 32 is fixed to the attachment portion 13 is an example of a first angle. In the above-mentioned embodiment, the inclination angle of the music score provision surface 30 with respect to the horizontal plane in a case where the connection portion 33 is fixed to the attachment portion 13 is an example of a second angle.

While preferred embodiments of the present disclosure have been described above, it is to be understood that variations and modifications will be apparent to those skilled in the art without departing the scope and spirit of the present disclosure. The scope of the present disclosure, therefore, is to be determined solely by the following claims.

We claim:

1. A musical instrument comprising:

a music stand including a music score provision surface;

a performance operation unit arranged in a front portion of the music stand in a front-and-rear direction; and an attachment portion arranged at a position farther rearward than a rear end of the performance operation unit in the front-and-rear direction and farther forward than an intermediate position between the rear end of the performance operation unit and a rear end of the musical instrument in the front-and-rear direction, wherein the music stand is attachable to the attachment portion, wherein, in a state where the music stand is attached to the attachment portion, the music score provision surface is inclined at a first angle, and wherein the first angle is in a range of 35 degrees to 55 degrees with respect to a horizontal plane.

2. The musical instrument according to claim 1, wherein: the music stand includes:

a main body including the music score provision surface; and a connection portion, which is disposed at a lower end of the main body, attached to the attachment portion, the music score provision surface extends outwardly from the connection portion at the first angle in a state where the connection portion is attached to the attachment portion.

3. The musical instrument according to claim 1, wherein the first angle is in a range of 40 degrees to 50 degrees with respect to the horizontal plane.

4. The musical instrument according to claim 1, wherein the music score provision surface is configured to rest a display device that displays information arranged between the performance operation unit and the attachment portion in the front-and-rear direction.

5. The musical instrument according to claim 4, wherein, in a state where the display device is resting on the music score provision surface and the state where the music stand is attached to the attachment portion, the attachment portion is disposed adjacent to a lower end of the display device.

6. The musical instrument according to claim 4, wherein the music score provision surface is arranged substantially parallel to the display device in the state where the display device is resting on the music score provision surface.

7. The musical instrument according to claim 1, further comprising an operation unit that receives an operation from a user arranged between the performance operation unit and the attachment portion in the front-and-rear direction.

8. The musical instrument according to claim 7, wherein the music score provision surface is arranged substantially parallel to the operation unit in the state where the music stand is attached to the attachment portion.

9. The musical instrument according to claim 1, wherein the music score provision surface includes an anti-slip texture or pad.

10. The musical instrument according to claim 2, further comprising a reinforcer at a back surface of the main body.

11. The musical instrument according to claim 2, further comprising:

an additional connection portion extending from the main body, wherein the additional connection portion is inclined at a second angle with respect to the horizontal plane, the second angle being different from the first angle.

12. A keyboard musical instrument comprising:

a keyboard;

a music stand including a music score provision surface arranged behind the keyboard in a front-and-rear direction; and an attachment portion arranged at a position farther rearward than a rear end of the keyboard in the front-and-rear direction and farther forward than an intermediate position between the rear end of the keyboard and a rear end of the musical instrument in the front-and-rear direction, wherein the music stand is attachable to the attachment portion, wherein, in a state where the music stand is attached to the attachment portion, the music score provision surface is inclined at a first angle, and wherein the first angle is in a range of 35 degrees to 55 degrees with respect to a horizontal plane.

* * * * *